US006828894B1

(12) United States Patent
Sorger et al.

(10) Patent No.: US 6,828,894 B1
(45) Date of Patent: Dec. 7, 2004

(54) ISOLATION TRANSFORMER ARRANGEMENT

(75) Inventors: Harald Sorger, Munich (DE); Thomas Ohlsson, Hässelby (SE)

(73) Assignee: Siemens Aktiengesellschaft, Münich (DE)

( * ) Notice: Subject to any disclaimer, the term of this patent is extended or adjusted under 35 U.S.C. 154(b) by 143 days.

(21) Appl. No.: 10/070,680

(22) PCT Filed: Aug. 30, 2000

(86) PCT No.: PCT/SE00/01662

§ 371 (c)(1),
(2), (4) Date: Mar. 7, 2002

(87) PCT Pub. No.: WO01/22445

PCT Pub. Date: Mar. 29, 2001

(30) Foreign Application Priority Data

Sep. 24, 1999 (SE) ..... 9903466

(51) Int. Cl.[7] ..... H01F 5/00

(52) U.S. Cl. ..... 336/200; 336/192; 336/198; 336/232

(58) Field of Search ..... 336/65, 83, 198, 336/192, 200, 206, 232

(56) References Cited

U.S. PATENT DOCUMENTS 4,692,604 A * 9/1987 Billings ..... 336/20
5,319,342 A 6/1994 Kuroki

FOREIGN PATENT DOCUMENTS

JP 6-325952 * 11/1994 ..... 336/200
WO WO 99/31683 6/1999

* cited by examiner

*Primary Examiner*—Tuyen T. Nguyen
(74) *Attorney, Agent, or Firm*—Schiff Hardin LLP

(57) ABSTRACT

An isolation transformer arrangement has an isolation transformer having magnetically coupled primary and secondary windings, one of which is formed of at least one planar conductive run formed on an associated face of an insulating substrate of a printed circuit board and the other is formed of a number of turns of an insulated wire conductor. The printed circuit board also has one or more discreet electric components arranged in two electrically separate circuits each circuit connectable to a respective one of the primary and the secondary windings of the isolation transformer. The insulation of the wire conductor winding provides a desired level of electrical isolation between the circuits necessary for use in medical equipment.

5 Claims, 2 Drawing Sheets

ISOLATION TRANSFORMER ARRANGEMENT

BACKGROUND OF THE INVENTION

1. Field of the Invention

The present invention relates to an isolation transformer arrangement and in particular to an arrangement suitable for providing an isolation barrier in medical equipment.

2. Description of the Prior Art

Many types of medical equipment include sensors which are in contact with a patient. Although these sensors operate at low voltage and current levels that do not present a shock hazard to the patient that hazard can occur if an electrical short circuit occurs within the equipment or if other equipment connected to the patient develops a fault and the relatively high voltage and current levels from an external power supply line are supplied to the sensors contacting the patient.

For these reason regulatory authorities of many countries, such as for example the F.D.A. in the USA which requires compliance with IEC 60606-1, specify that medical equipment must be designed with an isolation barrier between circuits containing patient connections and circuits connected to power supply line voltages. Such isolation barriers must isolate, against several kilovolts AC with a leakage current of only several microamperes when the supply line voltage is applied across the isolation barrier. Typically, suitable isolation barriers are formed using isolation transformers, usually mounted on a printed circuit board (PCB) containing the circuits to be isolated. Generally, one of the two circuits between which an isolation barrier is required is electrically connected to the primary transformer winding or windings and the other circuit to the secondary transformer winding or windings.

One known type of isolation transformer is a "bobbin-type" isolation transformer which has a hollow plastic former or bobbin about which wires are wound to form the primary and the secondary windings and through which a ferrite core piece passes. The primary and secondary windings may be wound concentrically, one on top of the other, or may be displaced from one another along the core to increase the so called "creepage distance". The necessary isolation may be achieved by sheathing the wire of the two sets of windings in a suitable insulating material. This provides a transformer which is relatively inexpensive to produce and one in which faulty windings can be readily replaced.

However, the isolation achieved in this type of transformer is largely due to the separation and insulation between wires and the windings which mitigates against reducing the size of the transformer for mounting on the PCB. Size of the transformer can become a major issue since the medical device typically needs to accommodate several PCBs, one or some of which may have mounted thereon isolation transformers, in as small a volume as possible. Moreover, complicated tapping arrangements for the windings are difficult to achieve in wire wound transformers and often lead to a high failure rate and a consequent increased unit cost.

Low-profile planar transformers are also well known as isolation barriers. In such transformers the primary and secondary windings are each formed by electrically conducting runs, usually on an insulating planar surface such as a surface of a PCB, for example a multi-layer PCB, and arranged so that successive runs are separated by an insulating PCB layer to provide at least part of the necessary isolation. The layer or layers that constitute each of the windings are then usually magnetically coupled by means of an inductive core member. Forming the windings on a PCB also provides an increased ease of tapping selected conducting traces to provide a selectable transformer output voltage as compared to tapping selected windings of a wire wound transformer. This also allows complex tapping arrangements to be constructed relatively simply and consistently.

However the bonding of the PCB layers is usually done by gluing which also contributes to the isolation but can lead to uncontrolled variations in the dielectric properties of the inter-trace insulation, for example through the uncontrolled formation of air bubbles within the glue as it is applied. This is of particular concern for the insulation between the primary and the secondary windings as it may adversely effect the isolation provided by the transformer This leads to the necessity for increased quality control and hence higher unit costs.

It is also known from PCT Application WO 99/31683 to provide a "hybrid" low profile transformer power supply formed by a flat winding primary coil magnetically coupled to a secondary coil having a winding pattern deposited on a substrate such as a PCB. The transformer is designed specifically for mounting outside a periphery of a PCB which carries circuitry to be powered from the transformer.

SUMMARY OF THE INVENTION

It is an object of the present invention to provide an isolation transformer of relatively small size in which the isolation characteristics can be readily controllable and which can be integrated with a PCB carrying circuitry to be isolated.

The above object is achieved in accordance with the principles of the present invention in an isolation transformer arrangement having an isolation transformer with magnetically coupled primary and secondary windings, one of which is formed by at least one insulating substrate with a planar conductor run on a surface thereof, and the other of which is formed by a number of turns of an insulated wire conductor, and wherein the insulating substrate is a multi-layer printed circuit board also carrying two electrically separate circuits respectively connectable to the primary and secondary windings, and wherein the insulation of the wire conductor provides a desired level of electrical isolation between the two circuits.

By providing one winding as a planar conductive trace on the PCB board carrying circuitry to be isolated by the transformer a reduction in size and an ease of tapping as compared with an all wire transformer is achieved and by providing an insulated wire winding substantially all of the electrical isolation necessary for medical use can be achieved by a suitable tailoring of that insulation in a manner well known in the art. Moreover, the isolation can be tested before the wire is turned to provide the transformer winding, thereby reducing the possibility of the completed transformer being rejected during quality control.

Usefully the wire may be turned about a hollow bobbin similar to the known bobbin type transformer arrangement or other former, such as a leg of an E-core ferrite element, to provide for ease of collocation of the primary and secondary windings into the final transformer. The bobbin (or former) and the planar windings may be releasably replaceable which has the advantage that, since the isolation is provided by the insulated wire, winding poor isolation caused by faulty insulation in an assembled transformer can be easily remedied without replacing the entire transformer and hence the entire circuitry contained on the PCB board.

DESCRIPTION OF THE PREFERRED EMBODIMENTS

Figure 1:
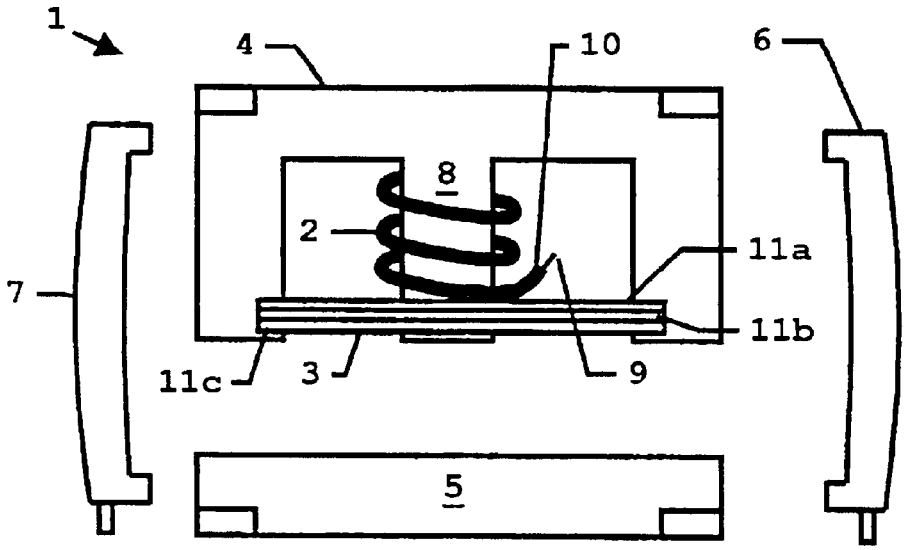
FIG. 1 shows details of an embodiment of the isolation transformer arrangement according to the present invention.

Referring to FIG. 1 details of an isolation transformer arrangement according to the present invention are shown. An isolation transformer 1 has a wire winding 2; a planar winding 3 and a magnetic core element comprising a conventional co-operating E-core 4 and I-core 5 arrangement. Spring clips 6,7 are provided to hold the cores 4,5 together in the assembled transformer.

The wire winding 2 has a number of turns helically wound about a central leg 8 of the E-core 4. The wire winding 2 is formed from a wire 9 within an insulating sheath 10 of sufficient thickness to provide an isolation between the wire 9 and the leg 8 and between the winding 2 and the planar winding 3 to withstand an applied voltage of 1500 V (RMS) and a 5000V defibrillation pulse which may be applied to a patient in cardiac arrest in an attempt to re-start or stabilize the heart output.

Figure 3:
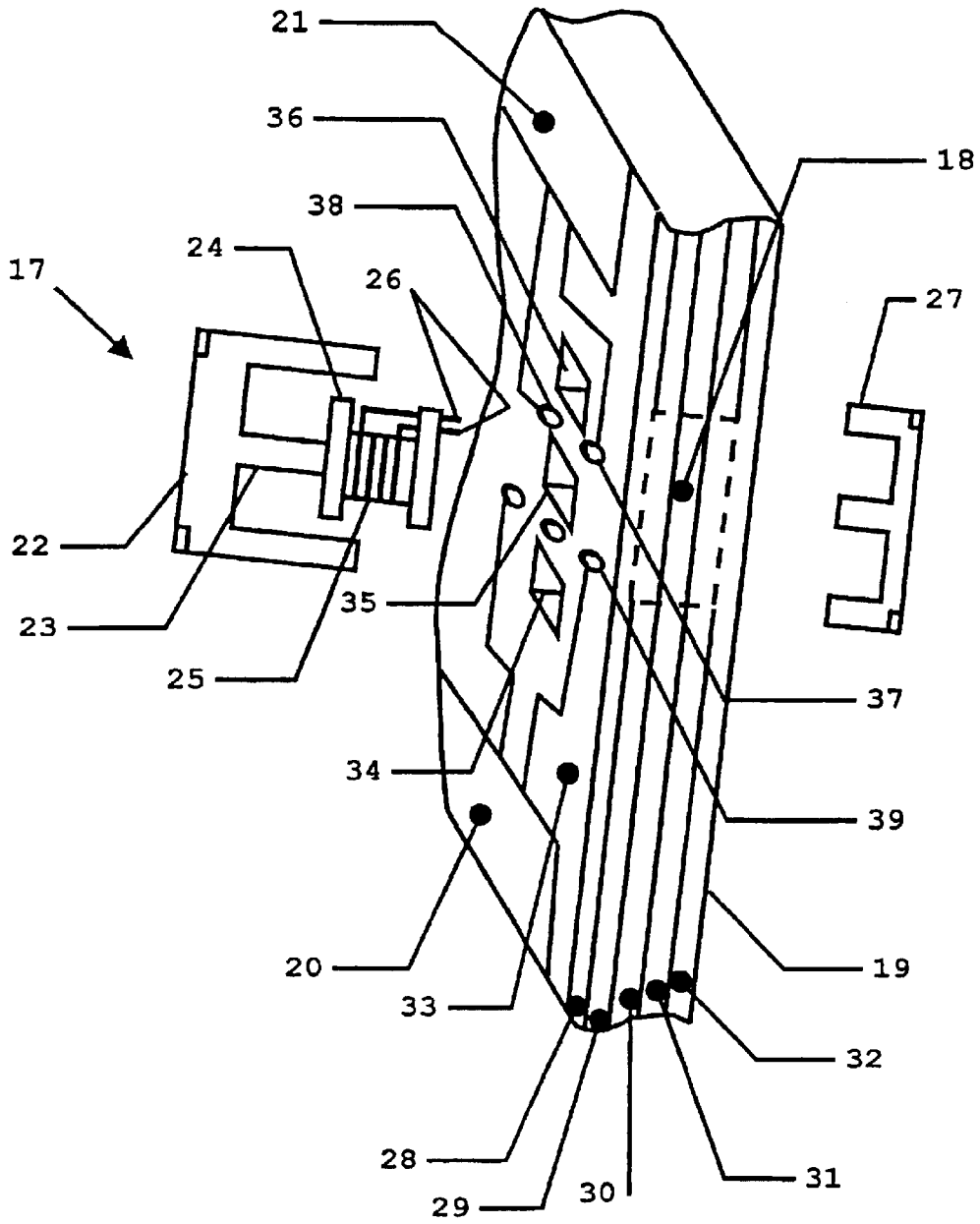
FIG. 3 shows an isolation transformer arrangement according to the present invention.

The planar winding 3 has a number of printed circuit boards (PCBs) 11*a*, 11*b* and 11*c* bonded to form a stacked arrangement locatable about the central leg 8 of the E-core 4 the PCBs 11*a*, 11*b* and 11*c* form a part of a PCB carrying electrical circuits to be isolated by the transformer 1 (see circuits 20,21 of FIG. 3). Thus the central leg 8 magnetically couples the two windings 2, 3 in the assembled transformer 1. Each circuit board 11*a*, 11*b*, 11*c* is, on at least one of its planar faces, is provided with a conducting run (not shown). These runs together form the conventionally formed planar transformer winding 3. Since the isolation is provided by the insulation 10 about the wire winding 2 then the isolation demand between any of the traces, whether on the same or another layer, is no higher than it would be between any run on a conventional printed circuit board.

Figure 2:
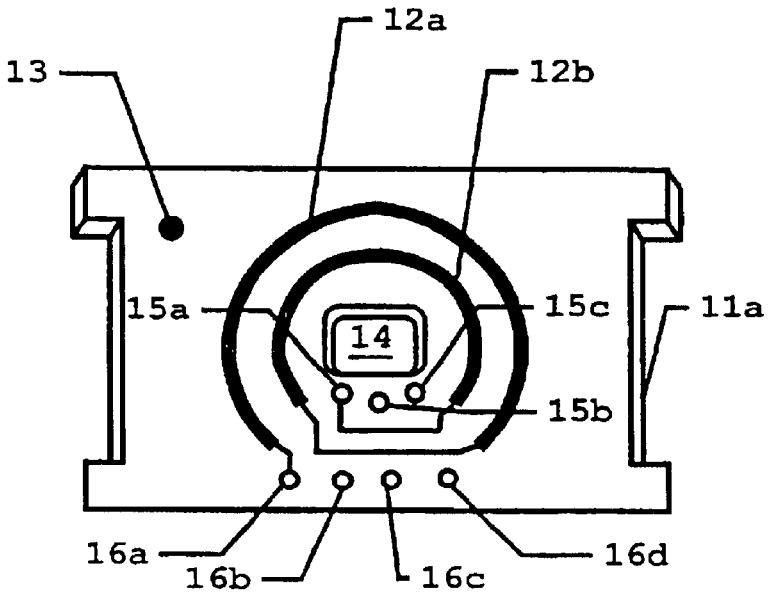
FIG. 2 shows an example of a planar conductive trace used as a component of a winding of the transformer of FIG. 1.

Considering now FIG. 2 an exemplary printed circuit board (here for example 11*a*) of the planar winding 3 is shown in more detail. A planar conductive run formed by two tracks 12*a*, 12*b* has been formed on one surface 13 of the printed circuit board 11*a* in a conventional manner. These tracks 12*a*, 12*b* are arranged concentrically with a hole 14 through the board 11*a* through which the central leg 8 of the E-core 4 (FIG. 1) passes. Through-holes 15*a*, 15*b*, 15*c* are also provided in the board 11*a* and are conductively plated to allow the electrical connection of runs on the other boards 11*b*, 11*c* which form the planar winding 3. Additional plated through-holes 16*a*, 16*b*, 16*c*, 16*d* are provided to allow electrical connections to be established between the planar winding 3 and external of the transformer 1 (for example to permit the connection of different combinations of tracks to different circuits which are also carried by the multi-layered PCB board 11*a*, 11*b*, 11*c*).

FIG. 3 also shows the arrangement according to the present invention. A planar winding 18 of the transformer 17 is shown together with circuits 20, 21 to be isolated from one another by the transformer 17 as integral parts of a multi-layer printed circuit board 19. The transformer 17 further has a first E-core 22 configured with a central leg 23 which passes through a plastic bobbin 24 about which is wound an insulated wire winding 25. Although the use of a bobbin 24 is preferred for ease of assembly it is possible to use a wire winding 2 which is spiraled directly about a central leg 8 of the core element 4, as illustrated in FIG. 1.

The winding 25 is insulated sufficiently to provide the substantially all of the desired isolation between the two windings 25,18 of the transformer 17. Contact legs 26 project from the base of the bobbin 24 and are connected to opposite ends of the wire winding 25 to provide for electrical connection of the winding 25 external of the transformer 17. Different to the transformer 1 of FIG. 1, a second E-core 27 (as opposed to the I-core 5 of FIG. 1) is provided to complete a magnetic flux path coupling the windings 18,25.

The circuit board 19 is here shown with 5 layers 28–32. The first layer 28 has an upper surface 33 on which the two circuits 20,21 to be isolated are realized. Three through holes 34, 35, 36 are provided and are dimensioned to permit passage through the board 19 of the legs of the E-cores 22, 27. Two plated recesses 37, 38 are provided in the upper surface 33 to receive the contact legs 26 and are electrically connected to the circuit 21, which is typically connected to receive mains power. Three plated holes 39 pass from the upper surface 33 to the planar winding 18 to provide electrical contact to different numbers of turns of the planar winding 18 and are electrically connected to the other circuit 20, which is typically connected to patient sensors (not shown). All of these electrical connections 34–39 can be readily arranged on the upper surface 33 of the multi-layer printed circuit board 19 to provide the correct creepage distances to meet the appropriate national or international regulatory requirements for the electrical isolation of medical equipment.

As illustrated in FIG. 3 the planar winding 18 is formed by the layers 29–31, each having on their upper surfaces (relative to the upper surface 27) a conductive track, for example similar to the tracks 12*a*, 12*b* shown in FIG. 2, to form the planar conductive winding 18 in the region shown by the broken lines. With this arrangement a degree of isolation between the wire winding 25 and the planar winding 18 is also provided by the thickness of insulating material in the layer 28.

Although modifications and changes may be suggested by those skilled in the art, it is the intention of the inventors to embody within the patent warranted hereon all changes and modifications as reasonably and properly come within the scope of their contribution to the art.

We claim:

1. An isolation transformer arrangement comprising:

an isolation transformer having two magnetically coupled coils respectively forming a primary winding and a secondary winding;

one of said two coils being formed by at least one insulating substrate having a surface with a planar conductor run thereon;

another of said two coils being formed by a plurality of turns of an insulated wire conductor;

said insulating substrate comprising a multi-layer printed circuit board carrying first and second electrically separate circuits each of said circuits being composed of one or more discreet electrical components;

said first electrical circuit being connected to a one of said primary winding and said secondary winding and adapted to receive a power supply line voltage;

said second electrical circuit being connected to another of said secondary winding and said primary winding and adapted for connection to a patient sensor; and said insulated wire conductor having insulation which provides a selected level of electrical isolation between said two first and said second circuits.

2. An isolation transformer arrangement as claimed in claim 1 wherein said isolation transformer comprises a hollow bobbin mounted on said surface of said printed circuit board, with said plurality of turns of said insulated wire conductor being wound on an exterior of said hollow bobbin, and wherein said printed circuit board has a through-hole therein and wherein said planar conductor run proceeds in coaxial paths around said through-hole, and further comprising a magnetic core element proceeding through said through-hole and said hollow bobbin to magnetically couple said primary and secondary windings.

3. An isolation transformer arrangement as claimed in claim 2 wherein said hollow bobbin with said plurality of turns of said insulated wire thereon is releasably replaceable on said surface of said printed circuit board.

4. An isolation transformer arrangement as claimed in claim 1 wherein said planar conductor run forms said secondary winding.

5. An isolation transformer arrangement as claimed in claim 1 wherein one of said two circuits is adapted for connection to a patient sensor and is connected to said planar conductor run, and wherein another of said two circuits is adapted to receive a power supply line voltage and is connected to said plurality of turns of said insulated wire conductor.

* * * * *